US010213679B1

(12) United States Patent
Carter

(10) Patent No.: US 10,213,679 B1
(45) **Date of Patent: *Feb. 26, 2019**

(54) SIMULATED INDIRECT FIRE SYSTEM AND METHOD

(71) Applicant: George Carter, Dallas, TX (US)

(72) Inventor: George Carter, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/698,615

(22) Filed: Sep. 7, 2017

Related U.S. Application Data

(63) Continuation-in-part of application No. 15/361,287, filed on Nov. 25, 2016, now Pat. No. 9,782,667, which is a continuation-in-part of application No. 14/498,112, filed on Sep. 26, 2014, now Pat. No. 9,504,907, which is a continuation-in-part of application No. 14/168,951, filed on Jan. 30, 2014, now Pat. No. 8,888,491, which is a continuation-in-part of application No. 13/611,214, filed on Sep. 12, 2012, now Pat. No. 8,678,824, which is a continuation-in-part of application No. 12/608,820, filed on Oct. 29, 2009, now Pat. No. 8,459,997.

(60) Provisional application No. 61/156,154, filed on Feb. 27, 2007.

(51) Int. Cl.
*A63F 9/02* (2006.01)

(52) U.S. Cl.
CPC .... *A63F 9/0291* (2013.01); *A63F 2300/8076* (2013.01)

(58) Field of Classification Search
CPC ..... A63F 9/0921; A63F 2300/8076; F41A 33/00; F41A 33/02; F41A 33/04; F41A 33/06; F41G 3/26
See application file for complete search history.

(56) References Cited

U.S. PATENT DOCUMENTS

| | | | | |
|---|---|---|---|---|
| 5,215,462 | A | 6/1993 | Lewis et al. | |
| 6,569,011 | B1 * | 5/2003 | Lynch | A63F 13/12 434/16 |
| 6,813,593 | B1 | 11/2004 | Berger | |
| 6,899,539 | B1 | 5/2005 | Stallman et al. | |
| 7,329,127 | B2 | 2/2008 | Kendir et al. | |
| 8,794,967 | B2 | 8/2014 | Sargent | |
| 2005/0181745 | A1 | 8/2005 | Wood et al. | |

(Continued)

*Primary Examiner* — Timothy A Musselman
(74) *Attorney, Agent, or Firm* — Michael Diaz

(57) ABSTRACT

An indirect fire simulation system includes a plurality of communication devices where each communication device is associated with a separate player. Each communication device includes a location services device for determining a location of the communication device which is communicated to a game server. The locations of all the communication devices are revealed to all the communication devices. Each communication device includes a directional orientation mechanism used when creating a targeting solution of a simulated indirect fire weapon. A processor is used for determining if a simulated targeting of another player by a simulated indirect fire weapon is a hit or miss based on the location indicia of a shooting communication device and the directional orientation of the shooting communication device. The targeting solution may be determined by aligning an aiming vector over the targeted communication device shown on a display of the shooting communication device.

31 Claims, 7 Drawing Sheets

(56) References Cited

U.S. PATENT DOCUMENTS

| | | | | |
|---|---|---|---|---|
| 2007/0190494 | A1 | 8/2007 | Rosenberg | |
| 2007/0190495 | A1 | 8/2007 | Kendir et al. | |
| 2007/0243504 | A1 | 10/2007 | Bjorkman et al. | |
| 2009/0305197 | A1 | 12/2009 | Lim et al. | |
| 2013/0130204 | A1* | 5/2013 | Lim | F41A 33/02<br>434/22 |
| 2015/0057057 | A1 | 2/2015 | Fischer | |

* cited by examiner

SIMULATED INDIRECT FIRE SYSTEM AND METHOD

RELATED APPLICATIONS

This application is a continuation-in-part application of co-pending U.S. Ser. No. 15/361,287 entitled "System and Method of Assigning a Target Profile for a Simulation Shooting System" filed Nov. 25, 2016 under the name of George Carter which is a continuation in part of U.S. Pat. No. 9,504,907 entitled "Simulated Shooting System and Method" filed Sep. 26, 2014 under the name of George Carter which is a continuation-in-part of U.S. Pat. No. 8,888,491 entitled "An Optical Recognition System and Method For Simulated Shooting" filed on Jan. 30, 2014 under the name of George Carter which is a continuation-in-part application of U.S. Pat. No. 8,678,824 entitled "Shooting Simulation System and Method Using an Optical Recognition System" filed on Sep. 12, 2012 under the name of George Carter which is a continuation-in-part application of U.S. Pat. No. 8,459,997 entitled "Shooting Simulation System and Method" filed on Oct. 29, 2009 under the name of George Carter which claims the benefit of U.S. Provisional Patent Application Ser. No. 61/156,154 filed Feb. 27, 2009 by George Carter, all of which is hereby incorporated by reference.

BACKGROUND OF THE INVENTION

Field of the Invention

This invention relates to simulation systems and methods. Specifically, and not by way of limitation, the present invention relates to an indirect fire simulation system and method.

Description of the Related Art

There are numerous laser tag games utilizing Infrared (IR) emitters and sensors for playing various forms of tag. However, these laser tag games require the use of relatively expensive IR emitters and sensors. U.S. Pat. No. 9,504,907 discusses a unique system and method of using communication devices, such as mobile phones, for simulating shooting. However, a system and method are needed which incorporated in a similar fashion as the methods and systems discussed in U.S. Pat. No. 9,504,907 for use in indirect fire weapons. Indirect fire refers to aiming and firing a projectile without relying on a direct line of sight between the weapon and its target as for direct fire.

Although there are no known prior art teachings of a device such as that disclosed herein, a prior art reference that discuss subject matter that bears some relation to matters discussed herein is U.S. Patent Application Publication 2007/0190494 to Rosenberg (Rosenberg). Rosenberg discloses a targeting gaming system for a group of users, each having a portable gaming device. Positional and orientation data is obtained and stored in a UTA server. Using the positional data and orientation data, a network server determines if a shot taken by one user is a hit or miss. Thus, Rosenberg utilizes a server adjudicated system where the server determines if a player's targeting of another player is a hit or miss. Additionally, Rosenberg does not disclose an indirect firing system. Rather, Rosenberg merely disclosed a line of sight firing system.

As there are no prior art references relating to indirect fire simulation systems as detailed above, it would be advantageous to have a system and method providing indirect fire simulations for a user. It is an object of the present invention to provide such a system and method.

SUMMARY OF THE INVENTION

In one aspect, the present invention is directed to an indirect fire simulation system. The system includes a plurality of communication devices where each communication device is associated with a separate player. Each communication device includes a location services device for determining some location indicia of the communication device and a mechanism for communicating the location indicia to a network. The location indicia provides a location of the communication device. The system also includes a game server communicating with the network for relaying the location indicia of each communication device to the plurality of communication devices. Each communication device includes a mechanism for determining a directional orientation of the communication device when creating a targeting solution of a simulated indirect fire weapon. A shooting communication device targeting a targeted player having a targeted communication device receives the location indicia of the targeted communication device. A processor is used for determining if a simulated targeting of another player by a simulated indirect fire weapon is a hit or miss based on the location indicia of a shooting communication device and the directional orientation of the shooting communication device. The processor determines a hit or miss of the targeting of another player and provides immediate feedback of a hit or miss to a shooting player of the shooting communication device. The targeting solution may be determined by aligning an aiming vector over the targeted communication device shown on a display of the shooting communication device.

In another aspect, the present invention is directed to a method of simulating targeting by indirect fire of a target. The method begins by associating a shooting communication device by a first player and a targeted communication device by a targeted second player. A geographic location of both the shooting and targeted communication devices is determined. The geographic location of the targeted communication device is relayed to the shooting communication device through a network. A targeting solution is created by the shooting communication device of the targeted communication device by aligning an aiming vector of the shooting communication device with the targeted communication device. A processor determines if the targeting is a hit based on the orientation of the aiming vector and the location of the targeted communication device. Immediate feedback of a hit or miss is then provided to a shooting player of the shooting communication device.

DESCRIPTION OF THE INVENTION

Figure 1:
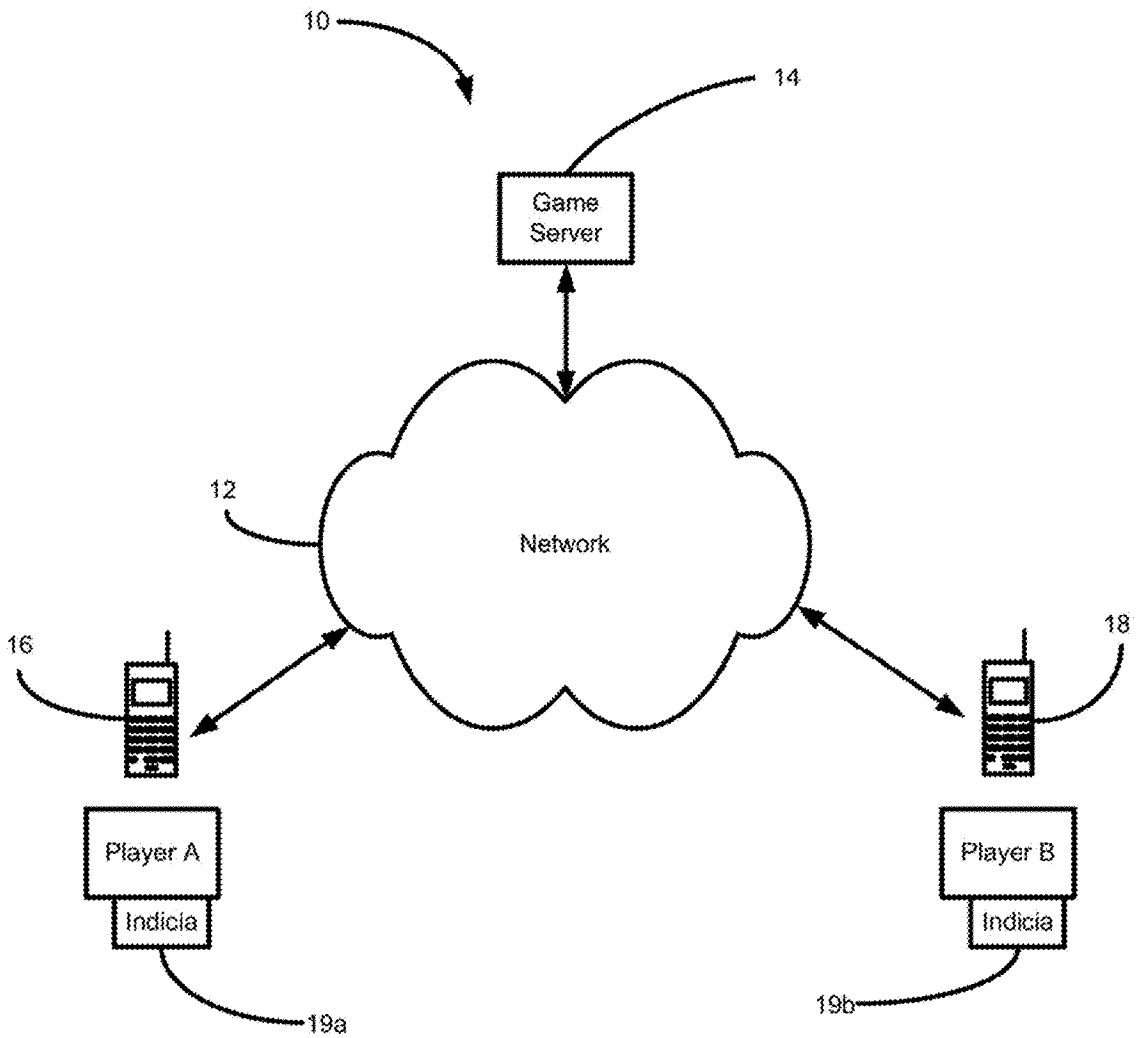
FIG. 1 is a simplified block diagram of an indirect firing simulation system 10 in one embodiment of the present invention.

The present invention is a shooting simulation system and method for an indirect firing weapon. FIG. 1 is a simplified block diagram of an indirect firing simulation system 10 in one embodiment of the present invention. The system 10 includes a wireless network 12, a game server 14, and a plurality of communication devices 16 and 18. The wireless network 12 may be any wireless communications network, such as a cellular network, any type of telecommunications network, Wi-Fi, etc. The game server 14 is a computing device communicating with the plurality of communication devices 16 and 18 via the network 12. The communication devices 16 and 18 may be any communication device capable of communicating via the wireless network, such as a tablet, phablet, portable computer, desktop computer, etc. It should be understood that the term "communication device" shall encompass any of these communication devices. Furthermore, two communication devices are depicted, however any number of communication devices may be utilized in the present invention. In addition, each communication device may function as a simulated indirect fire device for a simulated airborne weapon system, such as a notional airborne drone or any indirect weapon, such as Beyond Visual Range (BVR) missile targeting. Additionally, each communication device is associated with a player using the communication device. The communication device may be carried and aimed, such as a mobile phone, or stationary and controlled by a player, such as a desktop computer. As shown in FIG. 1, the communication device 16 is associated with a player A and communication device 18 is associated with a player B.

In one embodiment, each player A and B includes some specific indicia 19 (19*a* is associated with player A and indicia 19*b* is associated with player B) associated with the player. The indicia 19 is a location indicia related to the geographical location of the player. In one embodiment, a processor, which may be located in the game server or the communication device, stores an identifier for each player as well as each player's location indicia. Each communication device playing in the game registers with a location and identifier (e.g., callsign or other type of identifier). The shooting communication device, when targeting a targeted communication device, is provided with the identifier (e.g., callsign or other identification) of the targeted communication device. The processor then can pair the shooter communication device and the targeted communication device. The location indicia may be calculated by any location aware communication device.

Figure 2:
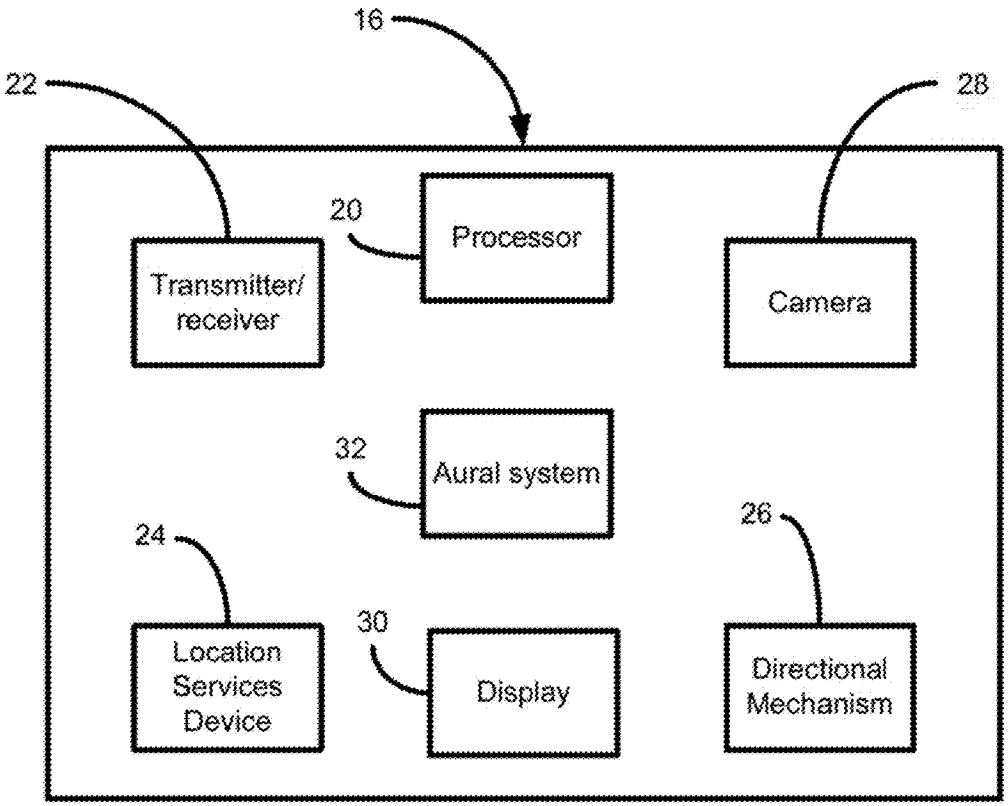
FIG. 2 is a simplified block diagram of the components of a communication device in one embodiment of the present invention.

FIG. 2 is a simplified block diagram of the components of a communication device in one embodiment of the present invention. The communication device 16 includes a processor 20, a transmitter/receiver 22, a location services device such as an Assisted Global Positioning System (A-GPS) device 24, and an optional directional mechanism 26 for determining a directional orientation of an aimed communication device. The directional mechanism may be incorporated into the location services device or be a separate component utilizing one or more accelerometers or a magnetometer to ascertain a direction of the aimed mobile phone. The processor 20 may be any computing device and incorporate the use of a software application, mobile application (e.g., "app") to accomplish the functions of the present invention. The communication device is a "location aware" device aware of its location. The directional mechanism 26 is utilized for mobile communication devices capable of being orientated in a specific direction. In another embodiment of the present invention, such as with a desktop computer, since the desktop computer cannot be easily positioned in a specific orientation, the user may be provided with a user interface allowing the orientation of an aiming vector for the indirect fire of a weapon.

The present invention may be utilized in a game or simulated combat scenario where players A and B are aligned on opposite sides. The present invention may utilize more than two players and include more than two teams. With this indirect firing system 10, the players are not within visual range and utilize simulated indirect firing weapon systems, such as missiles. In one embodiment, the players utilize their communication devices 16 and 18 by orientating the communication devices at an opposing player shown on a display and actuating a simulated triggering mechanism for simulating targeting of the opposing player. In this embodiment, the player is aiming and simulating employing indirect fire, such as directing a missile to a specific target, designating a target for a strike by a notional airborne drone, utilizing mortars, artillery, helicopters, other over the horizon weapons, etc. The game server 14 communicates with all the communication devices and stores the location of all such communication devices. The game server may then provide the location of other communication devices and associated players to all players. In one embodiment, the location of specific players may be displayed on a visual display. With the knowledge of the position of other players provided by the game server, the communication device may be orientated in a specific direction (i.e., "aimed") at the opposing player. In one embodiment, the communication device (for mobile devices such as a mobile phone), is longitudinally aligned (directional or azimuth) with the desired target displayed on the display. Upon actuation of the trigger or simulated trigger, the processor of the communication device may determine the direction of the communication device. It may be determined (adjudicated) by the processor of the shooting mobile phone or by the game server having a processor if there would be a hit or miss. In another embodiment where it is not possibility to orientate the communication device along a line with the target (such as with a desktop computer), a display may be provided to the player which allows a simulated positioning of an aiming vector which is orientated relative to the targeted player.

The game server 14 receives location data (e.g., A-GPS data from each communication device) and may independently determine/verify a hit or miss of the target. Since the game server may know the position of each player and the information on the triggered simulated indirect fire weapon (i.e., the orientation of the communication device), the game server may determine/verify a hit or miss. Alternatively, the game server may relay location data of the opposing player's communication device to the firing player's communication device and enable the processor 20 to determine if the fired shot would have been a hit or miss. Additionally, the game server 14 may manage the location of all the players as well as compiling all the hits and misses of each player at a specific location and time during the simulation. This compilation may be used for debrief of the players and determination of the success of each player and each team. The game server may compile a wide variety of data, such as time of firing, accuracy, number of munitions fired, times the player is targeted, etc. In one embodiment, the game server may provide a playback of each encounter providing a graphical representation of each player, trajectory of the simulated indirect munitions, or targeting of the drone. Furthermore, the game server may send back information on a hit or miss to the intended target. For example, the target and its associated communication device may be informed that he is killed by receiving an aural warning. In addition, the game server may determine a size or pattern of what is defined as a "hit" or "miss". For example, a confirmed "hit" may be reduced to a smaller pattern (e.g., a smaller concentric circle or circles for which a hit is scored). Additionally, the game server may provide a handicap based on previous performance of the player for the determination of a hit.

Figure 3:
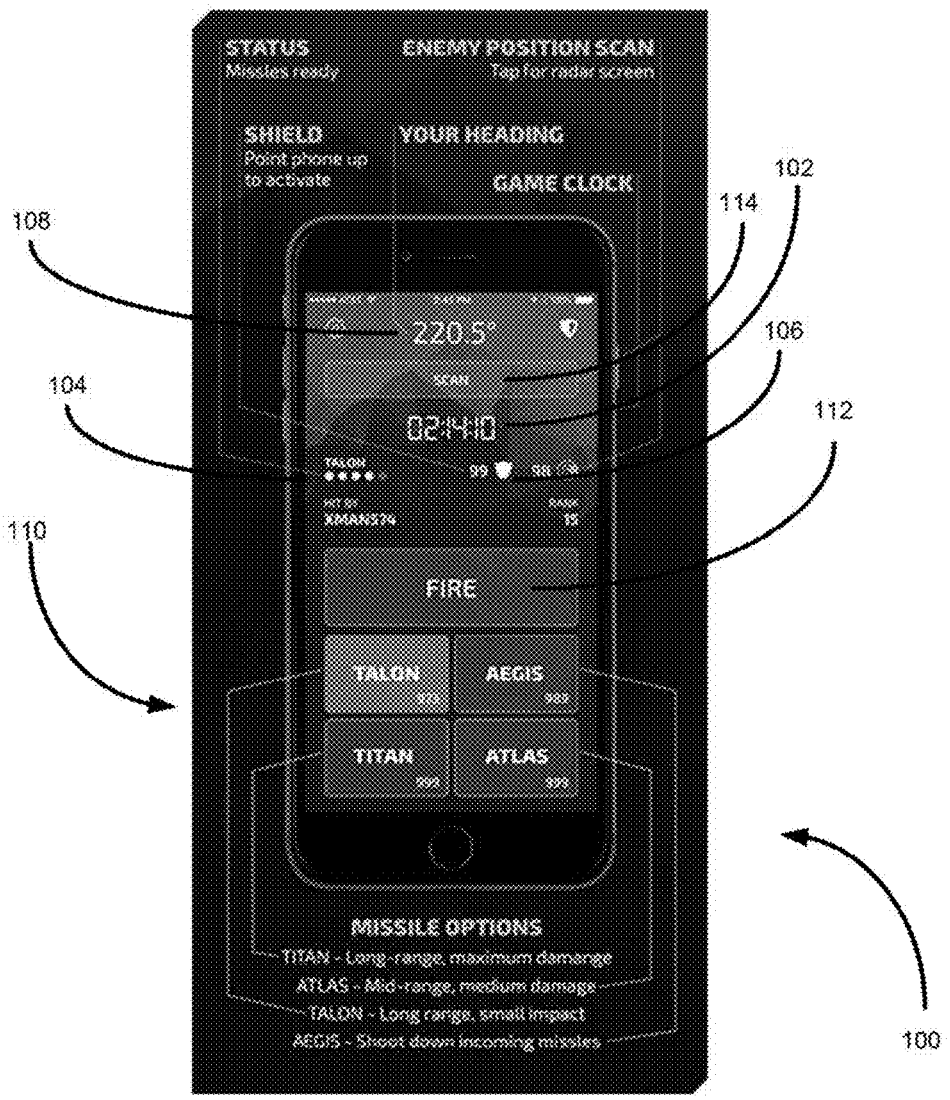
FIG. 3 illustrates a control display 100 for use with the communication device.

FIG. 3 illustrates a control display 100 for use with the communication device 16. In one embodiment, the control display may provide various types of information to the user, such as a game clock 102, a weapon status 104, a shield status 106, the player's heading (aiming vector for the munitions used) 108, weapons selection menu 110, and a firing mechanism 112. The game clock may provide an elapsed time play of the game or remaining time of the current game. The weapon status may provide a count of remaining munitions of the player while the shield status 106 may provide a count of shield actions remaining. The weapons selection menu 110 may be used to provide the selection of a specific munition. For example, a "Titan" missile is used for long range targeting with maximum damage. An "Atlas" missile provides mid-range targeting for medium damage. A "Talon" missile is another long-range missile for a small target and an "Aegis" missile may be used for shooting down incoming missiles. The player may select the desired munition and press the firing mechanism 112 (trigger). A scan button 114 may be used for displaying a scope display 150 (see FIG. 4).

Figure 4:
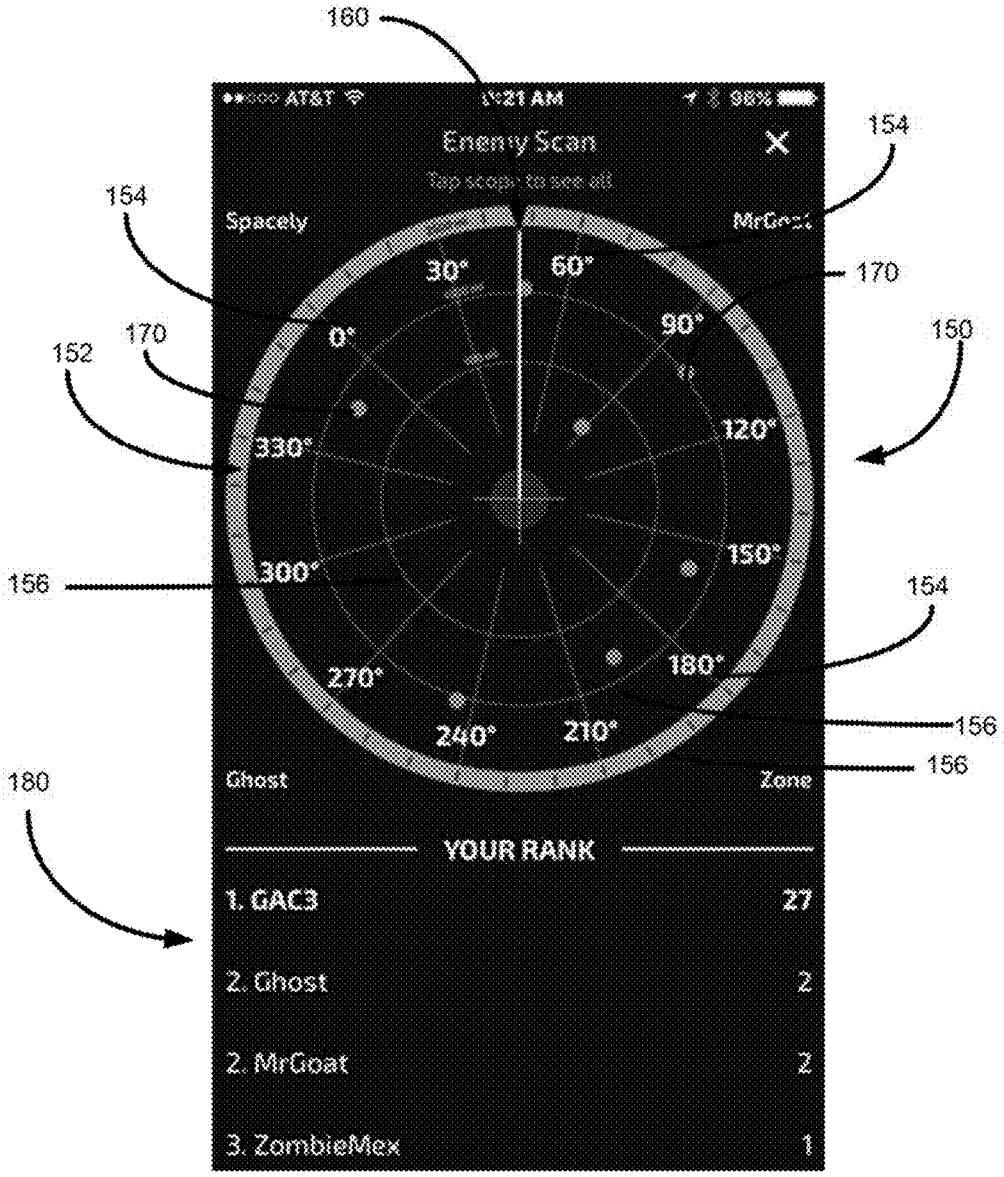
FIG. 4 illustrates the scope display 150 in one embodiment of the present invention

FIG. 4 illustrates the scope display 150 in one embodiment of the present invention. The scope display 150 may show a scope representation 152 having one or more orientation lines 154 and concentric circles 156 representing different ranges of targets. The position of other players may be displayed on the scope relative to the player. The scope representation may include a lubber line 160 (aiming vector) which represents the firing direction of the player. In one embodiment, the lubber line may be placed over a target 170 by orientating the communication device in such a fashion as to place the lubber line over the target. The game server provides locations of the other players to the communication device. The processor may then calculate and display the position of the "targets" 170 on the scope representation. The range of the targets are visually displayed by use of the concentric circles 156. By referencing the range of the target, the player may select the munition most likely to be effective against the target. The targets may be labeled with the players' names. Additionally, in one embodiment of the present invention, the players' ranking may be displayed on the rank table 180. In another embodiment of the present invention (not shown) where the communication device cannot be orientated (e.g., desktop computer), the scope display may include a mechanism for moving the lubber line to overlay the selected target.

Figure 5:
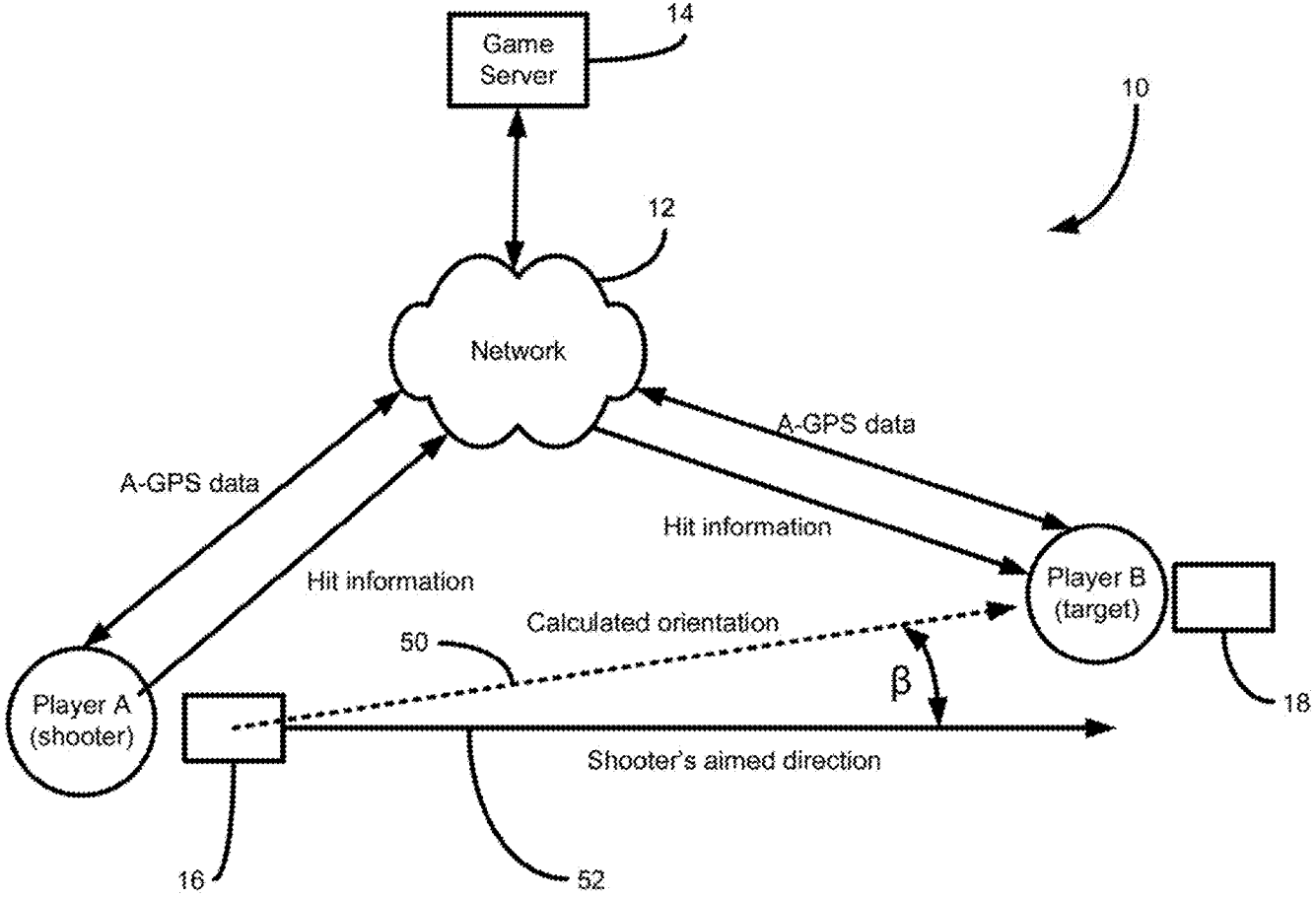
FIG. 5 is a simplified block diagram illustrating the interaction of the components for use in the present invention.

FIG. 5 is a simplified block diagram illustrating the interaction of the components for use in the present invention. With reference to FIGS. 1-5, the operation of the system 10 will now be explained. Each player carries or operates a communication device 16 or 18. The communication device includes a location services device 24 for determining the location of the communication device. The position of the communication device may be transmitted to the game server 14. The game server may than transmit positions of the players to each player engaged in the specific game. The processor 20 of the communication device may generate the scope display 150 showing the various targets 170 based on the received positions from the game server. With the targets displayed on the scope representation 152, in one embodiment, player A orientates the lubber line 160 over a selected target 170, selects a weapon form the weapon selection menu 110 and fires using the firing mechanism 112. The game server or the processor of the shooting player (e.g., player A) communication device determines if is a hit or miss. In this embodiment, the direction mechanism is used for determining the lubber line (aiming vector of the weapon). For example, in FIG. 3, the player A aims the communication device 16 at player B. The directional mechanism 26, ascertains an aimed direction or azimuth 52 for which the communication device is aimed. The processor 20, by knowing the location of the communication device 16 (player A) and communication device 18 (player B), can determine a calculated orientation 50 between the two communication devices. The game server 14 or the shooting communication device (e.g., communication device 16) may provide a hit criteria, such as a maximum β angular error for which a shot would be scored as a hit. The hit criteria may be set in various ways. In one embodiment, the radius of the "kill zone" may be increased or decreased as desired. Alternatively, the simulated munition may be increased or decreased in size. In either case, a hit is determined by the directional accuracy. In another embodiment, the location of both communication devices at the time of trigger actuation is sent to the game server which adjudicates whether the munition fired or targeting is a hit or miss. The information of a hit (and optionally a miss) may be relayed to either the shooting player or both the shooting and targeted players' communication device. It should be understood that trigger actuation refers to any shooting or targeting with the munitions at an opposing player. Additionally, the players may include a shield providing a shield to protect from incoming munitions. The player may be provided with a limited number of shields. The hits and/or misses may be relayed to the game server for a total tally by the game server. In another embodiment where the communication device cannot be orientated in a different direction (e.g., a desktop computer), the lubber line (aiming vector) on the scope representation may be moved visually on the display. In another embodiment of the present invention, the simulated indirect fire weapon may be fired from a different or remote location than the shooting communication device. The remote location may be mobile, such as an indirect fire weapon (e.g., missile) fired from a nuclear submarine or a tank. For example, the shooting communication device may represent a command and control weapons center command weapons fired from different locations, such as a nuclear missile base located at a different location.

Figure 6A:
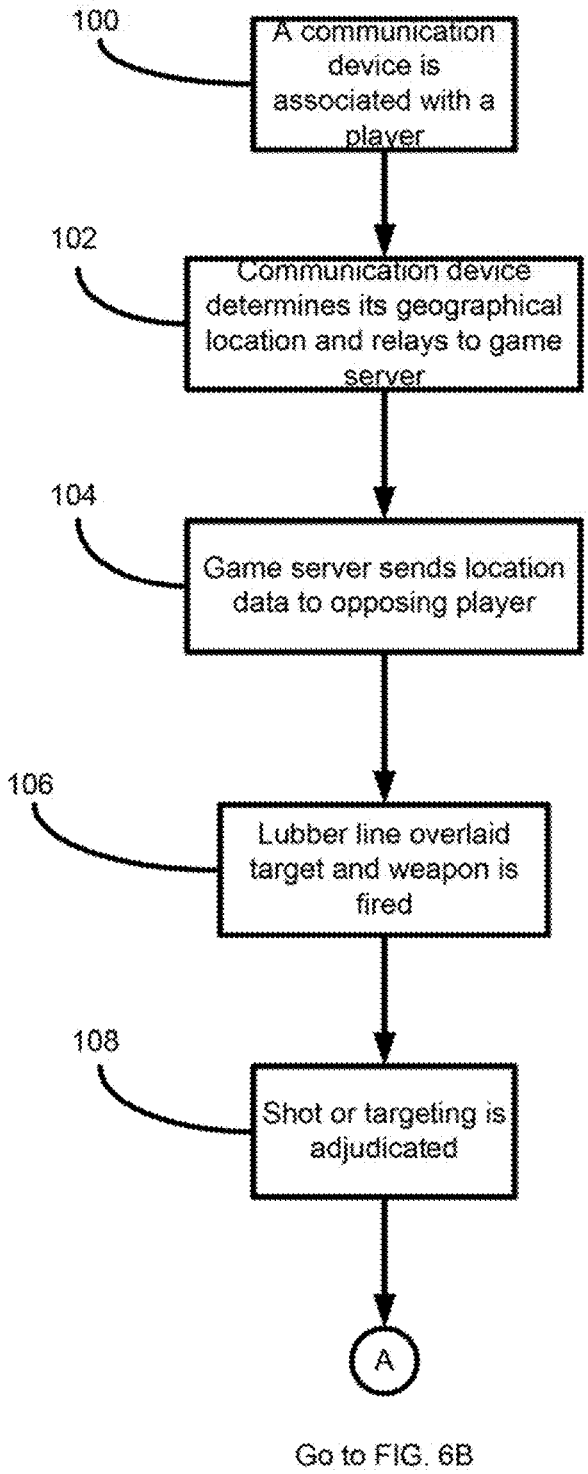
FIGS. 6A and 6B are flowcharts illustrating the steps of utilizing the system according to the teachings of the present invention.
Figure 6B:
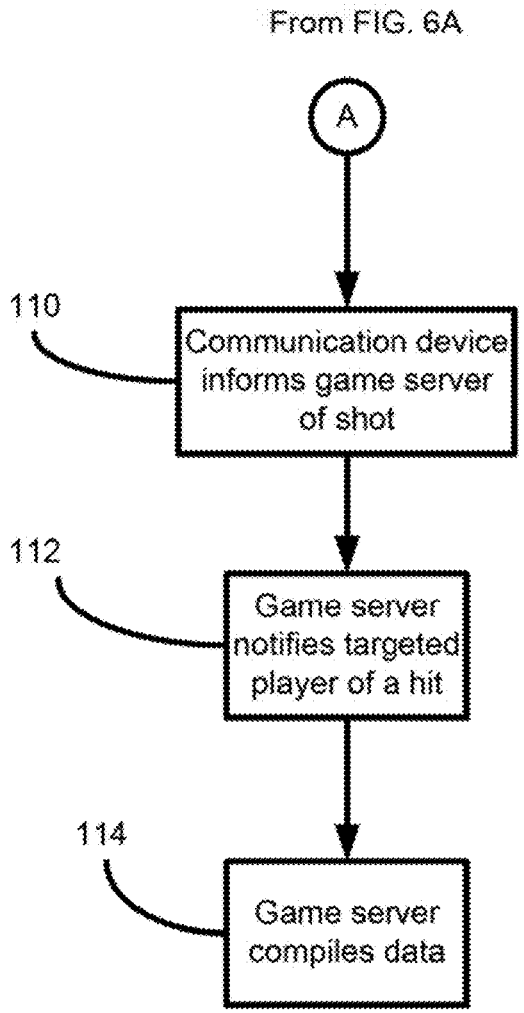

FIGS. 6A and 6B are flowcharts illustrating the steps of utilizing the system 10 according to the teachings of the present invention. With reference to FIGS. 1-6, the method will now be explained. In step 100, each player is associated with a communication device 16 or 18. In step 102, each communication device continually determines its geographical location or indicia and relays this information to the game server. In step 104, the game server 14 sends the opposing player's location information (indicia) to the other player (e.g., player B's geographical location is sent to player A's communication device). The opposing players geographical information may optionally be displayed to the player for providing situational awareness of a general directional orientation of the player on the scope representation 152. In step 106, player A overlays the lubber line or other orientational indication on the selected target and actuates the trigger. This can be accomplished by orientating the communication device as necessary or, in another embodiment, moving the lubber display on the scope representation by some other means visually. The firing mechanism 112 may then be actuated. Next, in step 108, the shot or targeting is adjudicated. In one embodiment, the processor in the shooting player's communication device 16 adjudicates if the shot or targeting was a hit or miss. In another embodiment, the game server receives the aimed direction 50 and true orientation 52 and determines if the shot or targeting was a hit or miss. In step 110, the communication device 16 may inform the game server of the shot or targeting and optionally the results (i.e., hit or miss) for tally by the game server. The hit or miss information may then be relayed to the targeted player's communication device 18. Next, in step 112, the game server 14 may inform the targeted player B's communication device 18 of a hit. The communication device may be informed by either aural feedback (e.g., sound indicated that player B has been hit) or visual feedback (e.g., visual signal on the display). In step 114, the game server 14 may then manage the location of all the players as well as compiling all the hits and misses of each player at a specific location and time during the simulation. This compilation may be used for debrief of the players and determination of the success of each player and each team. The game server may compile such data as time of firing, accuracy, number of munitions expended, times the player is targeted, etc.

The present invention provides many advantages over existing shooting simulation systems. The present invention is a method and system providing the simulation of indirect fire weapons unlike other existing systems which rely on visual acquisition of the target. Thus, the present invention enables the simulation of a wide variety of weapons which cannot be simulated in existing systems. Additionally, the present invention may be incorporated in existing mobile phones.

The present invention may be utilized between two players or multiple players on two or more teams. The present invention may be used as a shooting simulation system and method by a simulated shooting firearm or by a device for targeting a player with a notional airborne drone.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An indirect fire simulation system, the system comprising:

a plurality of communication devices, each communication device associated with a separate player, wherein each communication device includes a location services device for determining some location indicia of the communication device and a mechanism for communicating the location indicia to a network, the location indicia providing a location of the communication device;

a game server communicating with the network for relaying the location indicia of each communication device to the plurality of communication devices;

wherein each communication device includes a mechanism for determining a directional orientation of the communication device when creating a targeting solution of a simulated indirect fire weapon;

wherein a shooting communication device targeting the targeted player having a targeted communication device receives location indicia of the targeted communication device;

wherein the shooting communication device aims and fires the simulated indirect fire weapon without having a direct line of sight between the communication device and a targeted player;

wherein each communication device includes a display providing a location of a targeted communication device;

wherein the targeting solution is obtained by aligning an aiming vector over the targeted communication device shown on the display; and a processor for determining if a simulated indirect targeting of another player by a simulated indirect fire weapon is a hit or miss based on the location indicia of a shooting communication device, the location indicia of the targeted communication device of the targeted player received from the game server, and the directional orientation of the shooting communication device;

the processor determining a hit or miss of the targeting of another player and providing immediate feedback of a hit or miss to a shooting player of the shooting communication device.

2. The indirect firing system according to claim 1 wherein the processor resides within the communication device of a shooting player.

3. The indirect firing system according to claim 1 wherein the processor resides within the game server.

4. The indirect firing system according to claim 1 wherein the aiming vector is aligned with the targeted communication device by orientating the communication device.

5. The indirect firing system according to claim 1 wherein the aiming vector is moved on the display.

6. The indirect firing system according to claim 1 wherein the communication device is a mobile phone.

7. The indirect firing system according to claim 1 wherein the shooting communication device provides aural feedback of a hit or miss of a targeting by the shooting communication device.

8. The indirect firing system according to claim 1 wherein the shooting communication device provides visual feedback of a hit or miss of a targeting by the shooting communication device.

9. The indirect firing system according to claim 1 wherein the communication device of the targeted player provides aural feedback to the targeted player upon receiving notice of a hit of the simulated targeting by the shooting communication device.

10. The indirect firing system according to claim 1 wherein the communication device of the targeted player provides visual feedback to the targeted player upon receiving notice of a hit of the simulated targeting by the shooting communication device.

11. The indirect firing system according to claim 1 wherein the game server provides some hit criteria for a hit or miss of a targeted player.

12. The indirect firing system according to claim 1 wherein the simulated indirect fire weapon is a missile.

13. The indirect firing system according to claim 1 wherein the simulated indirect fire weapon is fired from a virtual remote location different than the shooting communication device.

14. The indirect firing system according to claim 13 wherein the virtual remote location is mobile.

15. The indirect firing system according to claim 1 wherein the indicia includes an identification of a communication device of a targeted player.

16. The indirect firing system according to claim 1 wherein the network is a telecommunications network.

17. The indirect firing system according to claim 1 wherein the network is a Wi-Fi network.

18. The indirect firing system according to claim 1 wherein the game server informs the communication device of the target player of a hit of a simulated targeting by the shooting communication device.

19. The indirect firing system according to claim 1 wherein the shooting communication device provides some hit criteria for a hit or miss of a targeted player.

20. The indirect firing system according to claim 1 wherein the indirect fire weapon is a beyond visual range weapon.

21. A method of simulating targeting by indirect fire of a target, the method comprising the steps of:

associating a shooting communication device by a first player and a targeted communication device by a targeted second player;

determining a geographic location of the shooting communication device;

determining a geographic location of the targeted communication device;

relaying the geographic location of the targeted communication device to the shooting communication device through a network;

creating an indirect fire targeting solution by the shooting communication device of the targeted communication device by aligning an aiming vector of the shooting communication device with a displayed location of the targeted communication device, wherein the shooting communication device aims and fires the simulated indirect fire weapon without having a direct line of sight between the communication device and a targeted player, wherein the targeting solution is obtained by overlaying an aiming vector over the targeted communication device shown on the display;

determining, by a processor, if the indirect fire targeting is a hit based on the orientation of the aiming vector and the location of the targeted communication device; and providing immediate feedback of a hit or miss to a shooting player of the shooting communication device.

22. The method according to claim 21 wherein the processor resides within the shooting communication device.

23. The method according to claim 21 wherein each communication device includes a display providing a location of a targeted communication device.

24. The method according to claim 21 wherein the aiming vector is aligned with the targeted communication device by orientating the communication device.

25. The method according to claim 21 wherein the aiming vector is moved on the display.

26. The method according to claim 21 wherein the step of relaying the geographic location of the targeted communication device includes relaying the geographic location to a game server communicating with the network.

27. The method according to claim 21 wherein the network is a Wi-Fi network.

28. The method according to claim 21 wherein the network is a telecommunications network.

29. The method according to claim 21 wherein the shooting communication device and the targeted communication device are mobile phones.

30. The method according to claim 21 wherein the step of creating a target solution includes simulating targeting for a notional airborne drone to strike the second player.

31. The method according to claim 21 further comprising the step of informing the communication device of the targeted player of a hit from the simulated targeting by the shooting communication device.

* * * * *